US007038589B2

(12) United States Patent
Schmidt et al.

(10) Patent No.: US 7,038,589 B2
(45) Date of Patent: May 2, 2006

(54) SYSTEMS AND METHODS FOR TRACKING AN OBJECT

(76) Inventors: Dominik J. Schmidt, 580 Arastradero Rd., Palo Alto, CA (US) 94306; Mark Dean Street, 2293 Walnut Grove Ave., San Jose, CA (US) 95128

( * ) Notice: Subject to any disclaimer, the term of this patent is extended or adjusted under 35 U.S.C. 154(b) by 0 days.

(21) Appl. No.: 10/287,327

(22) Filed: Nov. 3, 2002

(65) Prior Publication Data

US 2004/0085209 A1 May 6, 2004

(51) Int. Cl.
*G08B 23/00* (2006.01)

(52) U.S. Cl. ..... 340/573.1; 340/539.1; 340/572.1; 342/47

(58) Field of Classification Search ..... 40/573.1, 40/539.1, 572.2, 572.1, 572.7, 825.71, 825.72, 40/572.4; 42/47, 118, 125, 133, 139, 142–144
See application file for complete search history.

(56) References Cited

U.S. PATENT DOCUMENTS

| | | | | |
|---|---|---|---|---|
| 5,021,794 | A * | 6/1991 | Lawrence | 342/457 |
| 5,448,221 | A * | 9/1995 | Weller | 340/539 |
| 5,646,593 | A * | 7/1997 | Hughes et al. | 340/573 |
| 5,812,056 | A * | 9/1998 | Law | 340/539 |
| 5,900,817 | A * | 5/1999 | Olmassakian | 340/573.1 |
| 6,114,957 | A * | 9/2000 | Westrick et al. | 340/568.1 |
| 6,215,814 | B1 * | 4/2001 | Ylitalo et al. | 375/148 |
| 6,297,737 | B1 * | 10/2001 | Irvin | 340/571 |
| 6,351,221 | B1 * | 2/2002 | Phillips et al. | 340/825.49 |
| 6,377,216 | B1 * | 4/2002 | Cheadle et al. | 343/700 |
| 6,459,371 | B1 * | 10/2002 | Pike | 340/539 |
| 6,570,610 | B1 * | 5/2003 | Kipust | 348/156 |

* cited by examiner

*Primary Examiner*—Phung Nguyen

(57) ABSTRACT

A portable apparatus to track an object includes a transmitter adapted to sending pulses of known duration and intensity; a receiver having one or more antennas to receive the pulses of known duration and intensity from the transmitter, the receiver and the transmitter having synchronized clocks to determine signal propagation time and distance, and wherein an alarm is generated if the determined distance exceeds a preset value.

25 Claims, 9 Drawing Sheets

SYSTEMS AND METHODS FOR TRACKING AN OBJECT

BACKGROUND

1. Field of the Invention

The present invention relates generally to a remote tracking and/or locating system.

2. Background of Related Art

One major fear for parents is that they may be separated from their child/children in a crowded area such as in a shopping mall. The recent rise in reported child abduction cases has only compounded this fear. Abduction by strangers is not the only type of abduction; parental abduction is a large and growing form of child abduction. Also, elderly adult are subject to being lost and/or abducted as well.

Various solutions have been devised to minimize the risk of lost children or seniors. For example, as discussed in U.S. Pat. No. 6,169,494 to Lopes, a prior art device to aid in the retrieval of lost children or people provides a bracelet assembly with an elongated flexible band. The band has a transparent portion through which one can read identification information. The identification information can include a person's name, phone number, address, etc. This information is used by others to help the lost person find their way home, or to contact a parent or guardian. The bracelet is most commonly made of a plastic type material which is looped around the wearer's wrist and fastened. An attaching means is used to snug the bracelet around the user's wrist. The identification information is usually written, typewritten or imprinted on a piece of paper or similar receiving medium and is affixed to the bracelet or slipped under the transparent portion.

One disadvantage with these bracelets is that the identification information is generally printed with ink which can be rubbed, smudged or possibly washed off. The plastic band can be easily torn or cut off. Also, no verification that the proper person is wearing the bracelet is difficult at best by people who are not familiar with the wearer or identified person. Moreover, beyond visual verification, there is no way to detect the location or presence of the bracelet.

The '494 patent discloses a biotelemetry tracking and locating system that uses a person's own physical or biological measurement as an identification code used by a tracked unit, e.g., a bracelet worn by a child, to track and/or locate the person from a tracking/locating unit, e.g., worn or carried by a parent. The tracking/locating unit includes a transmitter and optionally a receiver. The tracking/locating unit detects a combination of encoded biological measurements (e.g. body temperature, and/or heart rate) and combines the biological measurements into a substantially unique ID code. The tracking/locating unit may be carried, e.g., by a parent to track the continued presence within a reception range of, e.g., a child wearing the tracked unit. A directional antenna, e.g., a YAGI type antenna, in the tracking/locating unit allows the tracking/locating unit to determine which direction the tracked unit is in, e.g., with respect to the tracking/locating unit. A panic button can be included with the tracked unit to allow a child or other person wearing a tracked unit to alert the tracking person, e.g., a parent to a dangerous situation. The tracking unit may include a paging button to output a paging signal to desired tracked units, which is emitted visually or aurally at the tracked unit.

SUMMARY

A portable apparatus to track an object includes a transmitter adapted to sending pulses of known duration and intensity; a receiver having one or more antennas to receive the pulses of known duration and intensity from the transmitter, the receiver and the transmitter having synchronized clocks to determine signal propagation time and distance, and wherein an alarm is generated if the determined distance exceeds a preset value.

Implementations of the above apparatus may include one or more of the following. The antenna can be positioned on a wearable object, such as on a watch or a body strap. The strap can be metal antenna fibers woven into clothing to prevent shielding. The antenna transceives extremely low frequency signals. The antenna can be a patch antenna such as an angled patch antenna or an angled patch antenna with one or more rake fingers. The receiver captures angle of arrival information using multiple patch antennas with a plurality of rake fingers. The receiver integrates signals from different antennas using a modified CDMA detection process. Prompt, late, early entries received by the rake fingers are correlated to determine arrival angles. The transmitter and receiver can be selected from either 802.11 transmitter and receiver or Bluetooth transmitter and receiver. The antenna is positioned on a secured body strap that can only be opened remotely. The object is a biological object such as a youngster or an elderly person.

In a second aspect, a portable apparatus to track an object includes a transmitter adapted to sending pulses of known duration and intensity; a receiver to receive the pulses of known duration and intensity from the transmitter, wherein the receiver and the transmitter operate with synchronized clocks to determine signal propagation time and distance and wherein the receiver captures angle of arrival information using multiple patch antennas with a plurality of rake fingers and signals from different antennas are processed using a modified CDMA detection process; and one or more antennas coupled to the receiver, the antennas having metal antenna fibers woven into clothing to prevent shielding, wherein an alarm is generated if the determined distance exceeds a preset value.

Implementations of the above aspects may include one or more of the following. The transmitter and receiver can be either 802.11 transmitter and receiver or Bluetooth transmitter and receiver. The antenna transceives extremely low frequency signals. The location signals can be ultrasound signals. The transmitter communicates with a remote network to transmit a user code and an approximate location as determined by the network. The network can be one of a local area network (LAN) and a wide area network (WAN). The network can also be one of a 802.11 network, a Bluetooth network, and a cellular network. The user code and approximate location tunnel through the network to a police computer or a national database. The distance measurement is accomplished by an active communication between the two units. A remote second unit with a second transmitter and a second receiver can communicate with the transmitter and receiver, wherein when the remote second unit senses emissions from the transmitter and receiver and emits signals to synchronize with the transmitter and receiver.

Advantages of the system may include one or more of the following. The system provides a cost-effective portable tracking and/or locating system which will uniquely identify the presence and location of an individual. The system is energy efficient so that a small battery can last a long time between battery replacement.

BRIEF DESCRIPTION OF THE DRAWINGS

The accompanying drawings, which are incorporated in and form a part of this specification, illustrate embodiments of the invention and, together with the description, serve to explain the principles of the invention.

DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
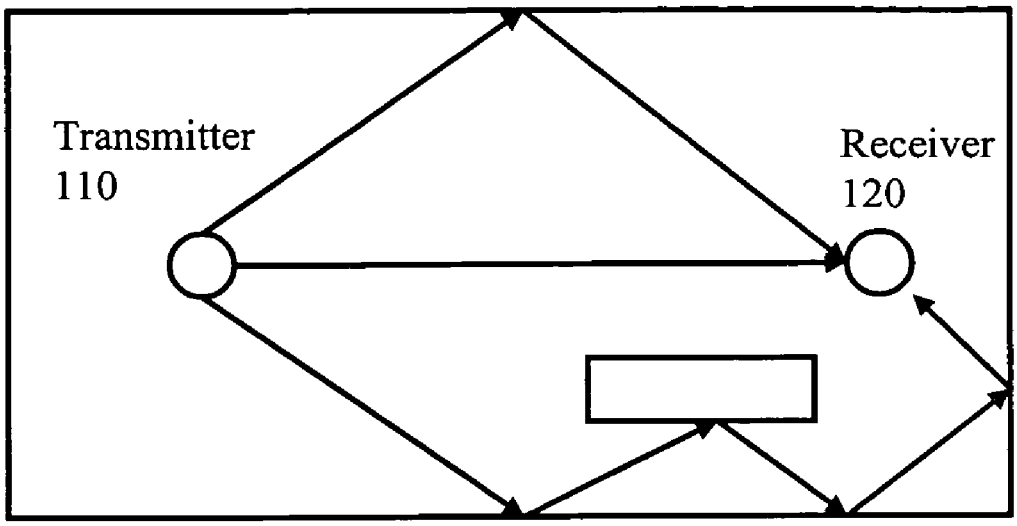
FIG. 1 shows an embodiment of a system to track an object such as a person.

FIG. 1 shows one embodiment of a location and communication system can be used within a short range (under 1000 feet). The system consists of two transceivers 100 and 120 which can detect each other's position and send messages between each other. If the units 100 and 120 separate in the field, alarms will sound on both units. One of the units 100 or 120 is designated as a main transmitter, and the main transmitter can be programmed to vary the detection range and to change the alarm parameters.

In one embodiment, the transceivers 100 and 120 use a high bandwidth signal such as 802.11 with a strong amplifier. A transmitter sends pulses of known duration and intensity. This is accomplished by synchronizing the clocks of the transmitter and receiver. If the transmitter sends data at a known clock cycle, and the receiver gets it at another clock cycle, a distance calculation can be made. The transmitter works continuously at low power, and at 2.4 GHz a 2.5 foot distance resolution can be obtained. To capture the angle of arrival information, the receiver has multiple patch antennas with a plurality of rake fingers which integrate the signal from different sources using a modified CDMA detection process. Prompt, late, early entries received by the rake fingers are correlated to determine arrival angles, not only different multipath conditions.

Figure 2:
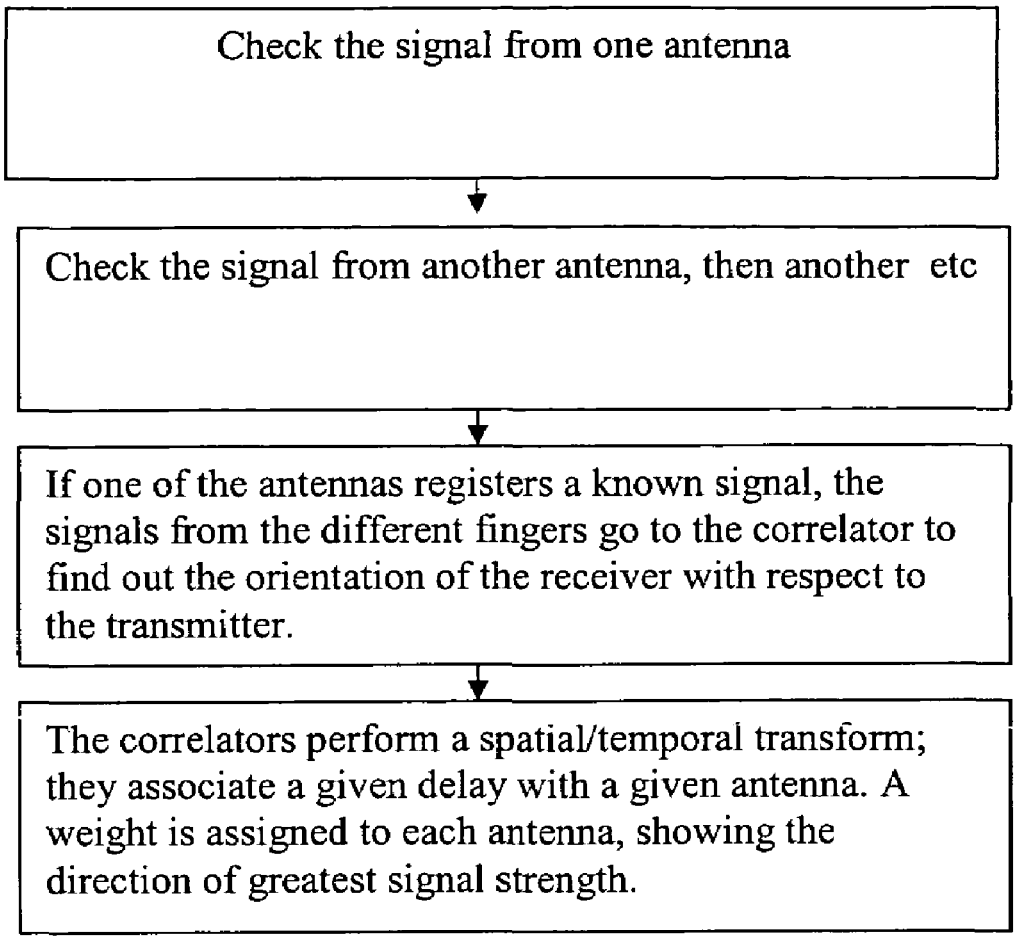
FIG. 2 shows a process detect position.

FIG. 2 shows a flow chart of a process to triangulate signals received by the rake fingers. The rake receiver is particularly useful where fading and multiple reflections are present. In this case the rake receiver will go through the following sequence:

1. Check the signal from one antenna
2. Check the signal from another antenna, then another, etc.
3. If one of the antennas registers a known signal, the signals from the different fingers go to the correlator to find out the orientation of the receiver with respect to the transmitter.
4. The correlators perform a spatial/temporal transform; they associate a given delay with a given antenna. A weight is assigned to each antenna, showing the direction of greatest signal strength.

The process of FIG. 2 solves the difficulty associated with estimating distance and arrival angle with a single transmitter and single receiver. Issues are spurious signals in the same frequency range, multi-path, fading and variable absorbers in the signal path.

The arrival delay of different signals tells the receiver which signal comes from the transmitter, and what signal is scattered.

The alarm will be activated by distance, to be preset by the user. If contact between the transmitter and receiver is interrupted, a quiet alarm sounds on the receiver. If this alarm is unheeded, a loud alarm starts on the transmitter.

Figure 3:
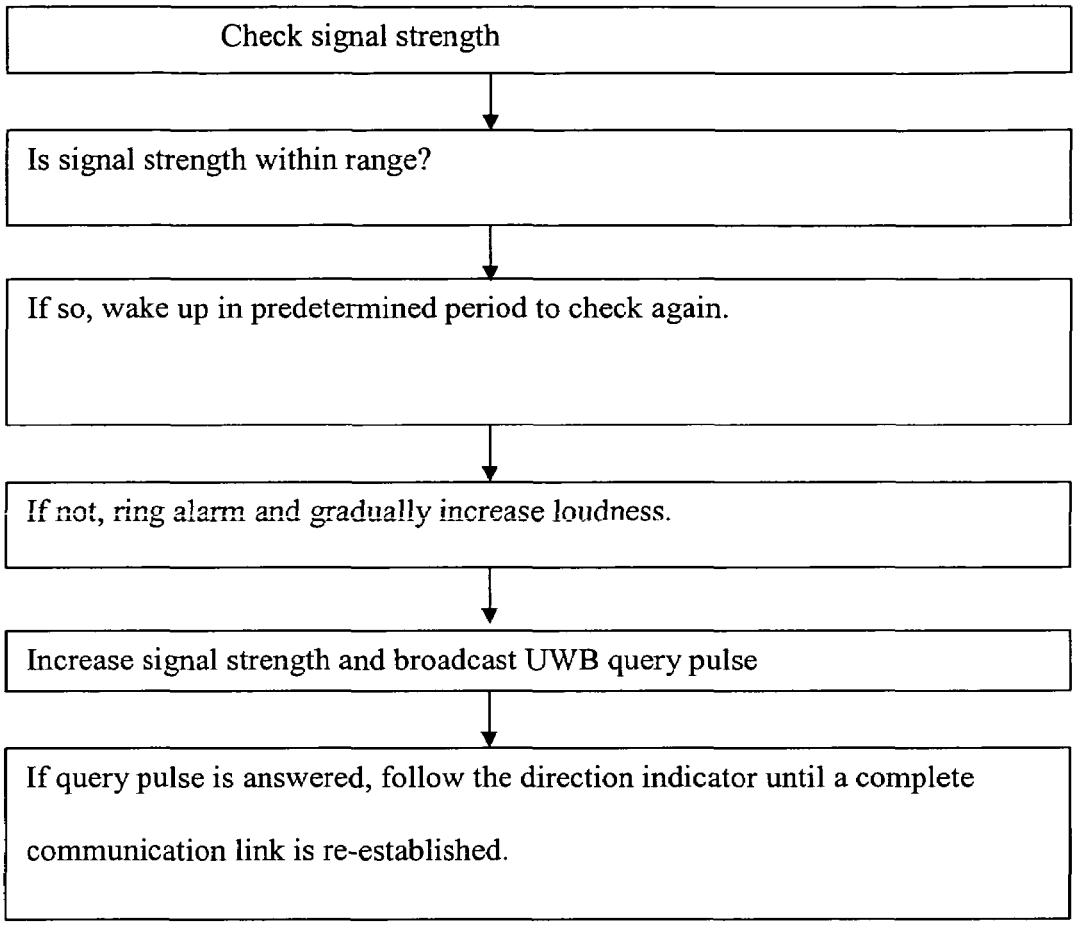
FIG. 3 shows a process to handle signal interruption.

In one embodiment, since signals from the child can be attenuated very quickly by placing a metal cover over the transmitter, the parent's receiver must quickly detect the reduced signal and activate an alarm and remember the last position and direction of the transmitter. This process is detailed in FIG. 3, whose pseudo code is reproduced below:

Check signal strength

Is signal strength within range?

If so, wake up in predetermined period to check again.

If not, ring alarm and gradually increase loudness.

Increase signal strength and broadcast UWB query pulse

If query pulse is answered, follow the direction indicator until a complete communication link is re-established.

The same procedure will be performed simultaneously by the receiver unit, which will also power up the antenna embedded in the clothes to increase signal range. The unit will also attempt to connect to any nearby wireless local area networks and alert authorities of the kidnapping.

The alarm will be activated by distance, to be preset by the user. If contact between the transmitter and receiver is interrupted, a quiet alarm sounds on the receiver. If this alarm is unheeded, a loud alarm starts on the transmitter.

Figure 4A:
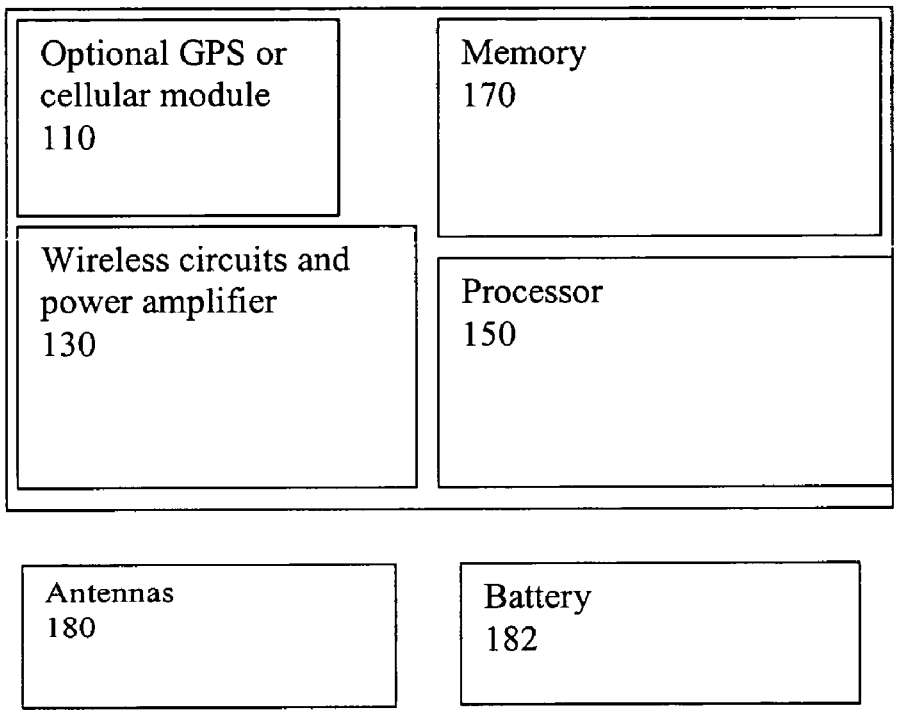
FIG. 4A is a block diagram of a wireless device to track the object.

FIG. 4A shows a block diagram of a transceiver device fabricated on a single silicon integrated chip. In one implementation, the device is an integrated CMOS device with radio frequency (RF) circuits, including an optional cellular radio core 110, a short-range wireless transceiver core 130, along side digital circuits, including a processor core 150 and a memory array core 170. The memory array core 170 can include various memory technologies such as flash memory and static random access memory (SRAM), among others, on different portions of the memory array core.

One exemplary processor core 150 includes a register bank, a multiplier, a barrel shifter, an arithmetic logic unit (ALU) and a write data register. The exemplary processor can handle DSP functions by having a multiply-accumulate (MAC) unit in parallel with the ALU. Embodiments of the processor can rapidly execute multiply-accumulate (MAC) and add-compare-subtract (ACS) instructions in either scalar or vector mode. Other parts of the exemplary processor include an instruction pipeline, a multiplexer, one or more instruction decoders, and a read data register. A program counter (PC) register addresses the memory system 170. A program counter controller serves to increment the program counter value within the program counter register as each instruction is executed and a new instruction must be fetched for the instruction pipeline. Also, when a branch instruction is executed, the target address of the branch instruction is loaded into the program counter by the program counter controller. The processor core 150 incorporates data pathways between the various functional units. The lines of the data pathways may be synchronously used for writing information into the core 150, or for reading information from the core 150. Strobe lines can be used for this purpose.

In operation, instructions within the instruction pipeline are decoded by one or more of the instruction decoders to produce various core control signals that are passed to the different functional elements of the processor core 150. In response to these core control signals, the different portions of the processor core conduct processing operations, such as multiplication, addition, subtraction and logical operations. The register bank includes a current programming status register (CPSR) and a saved programming status register (SPSR). The current programming status register holds various condition and status flags for the processor core 150. These flags may include processing mode flags (e.g. system mode, user mode, memory abort mode, etc.) as well as flags indicating the occurrence of zero results in arithmetic operations, carries and the like.

The processor core 150 controls the optional cellular radio core 110 and the short-range wireless transceiver core 130. The short-range wireless transceiver core 130 contains a radio frequency (RF) modem core that communicates with a link controller core. The processor core 150 controls the link controller core. In one embodiment, the RF modem core has a direct-conversion radio architecture with integrated VCO and frequency synthesizer. The RF-unit includes an RF receiver connected to an analog-digital converter (ADC), which in turn is connected to a modem performing digital modulation, channel filtering, AFC, symbol timing recovery, and bit slicing operations. For transmission, the modem is connected to a digital to analog converter (DAC) that in turn drives an RF transmitter.

The link controller core provides link control function and can be implemented in hardware or in firmware. One embodiment of the core is compliant with the 802.11 specification and processes 802.11 signals. For header creation, the link controller core performs a header error check, scrambles the header to randomize the data and to minimize DC bias, and performs forward error correction (FEC) encoding to reduce the chances of getting corrupted information. The payload is passed through a cyclic redundancy check (CRC), encrypted/scrambled and FEC-encoded. The FEC encoded data is then inserted into the header. Another embodiment of the core is compliant with the Bluetooth specification and processes Bluetooth signals.

A clock controller can be provided to operate from a single input frequency (in this example, 2.4 GHz) to generate clocks for both digital and wireless circuits. The clock can be programmed so that during synchronization, the clock edges of the current clock controller and a remote clock controller are in sync.

The clock controller optimizes speed, power, and radio frequency interference considerations. For example, if maximum processing power is required during the position triangulation process, the clock controller clocks the system at maximum speed where both the processor and RF circuits are clocked at 2.4 GHz. When processing load is reduced, the clock controller divides the 2.4 GHz clock down to a 1.2 GHz clock for the processor.

A second order harmonic of the 2.4 Ghz clock signal is used for the RF circuit. The controller can also use the 2.4 GHz with a filter circuit to remove sharp clock edges for RF the circuit. The clock controller manages the generation of the clock signals to minimize undesirable EMI emissions that can cause interference. Generally, digital circuits switch quickly between predefined voltage levels, and consequently induce transient disturbances in signal and power lines, as well as energy radiated as electromagnetic waves. A digital circuit switching rapidly but regularly, with edges synchronous to a master clock, can generate noise with a strong spectral component at the clock frequency. Additionally, harmonics at odd multiples of the clock frequency will be generated. If the circuit remains synchronous to a master clock, but switches on random clock edges, spectral components above and below the clock frequency will also be generated.

Digital circuits themselves are robust in the presence of noise from other sources. By contrast, analog circuits operate at a multiplicity of voltage levels and frequencies, and are sensitive to induced noise. The noise spectrum produced by dense, high-speed digital circuits can easily interfere with high-frequency analog components. Since the waveforms transitions generated by digital circuits are, at least ideally, step transitions having (in accordance with Fourier analysis) a wide noise bandwidth, potential interference of the chip's digital signals with the chip's analog signals poses a distinct threat to circuit performance.

In one embodiment, the clock controller generates a processor clock signal at a frequency that is lower than the RF frequency (2.4 GHz in the case of Bluetooth) to avoid interference. Further, the controller ensures that the edges of the clock do not generate harmonics that interfere with the 2.4 GHz frequency. In one implementation, the first harmonic of a 1.2 GHz signal is used as the 2.4 GHz carrier frequency.

When 2.4 GHz operation is desired, the clock is rapidly increased to 2.4 GHz with a suitable phase locked loop fed to both the processor core and the 802.11 core or the Bluetooth core. The digital clock can be transformed into an analog carrier wave using a gaussian filter and a lowpass filter such as a high-order Chebyshev or Butterworth filter.

Figure 4B:
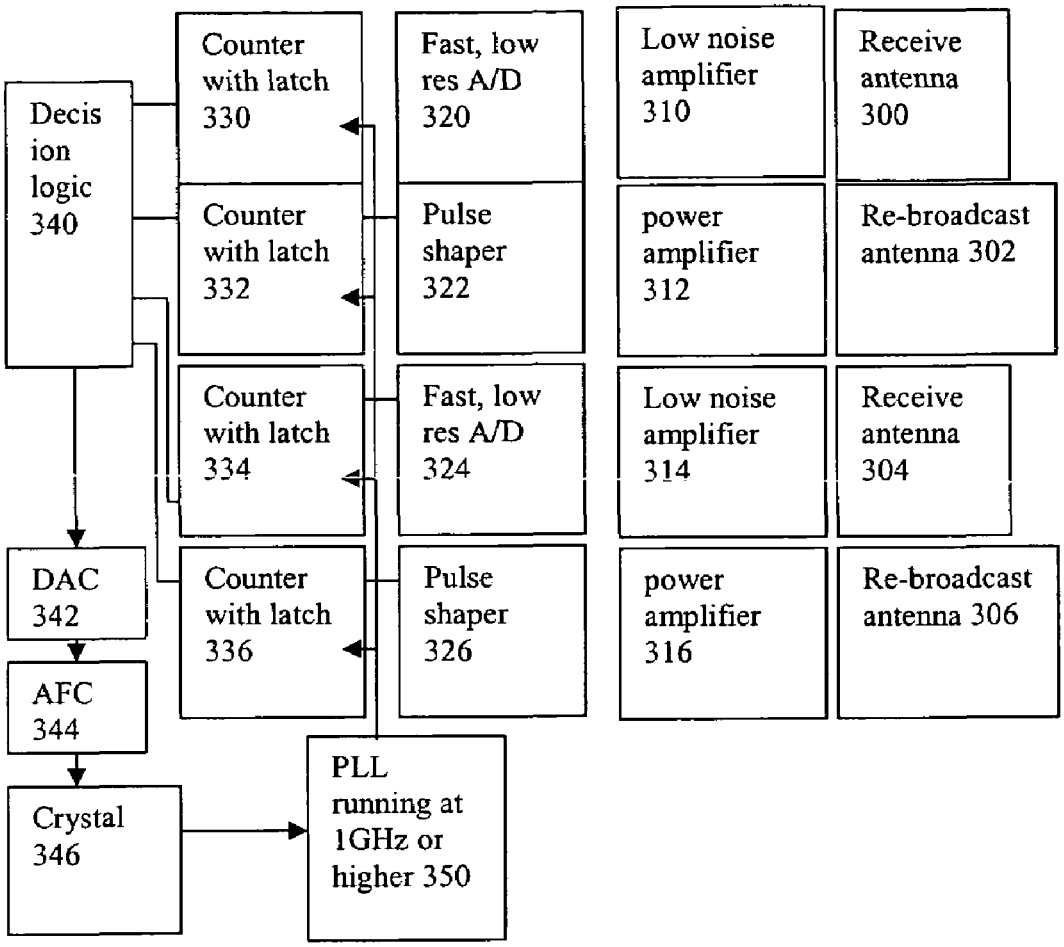
FIG. 4B is a block diagram of a second embodiment of a wireless tracking device.

FIG. 4B shows another embodiment that uses a combination of UWB (ultra wide band) and spread-spectrum radio frequency systems. The UWB signal is used for distance and angle measurement, while the spread-spectrum signal is used to send data over the unlicensed bands. The radio would in effect be able to control the emission bandwidth from a UWB system to a narrowband system.

In FIG. 4B, a plurality of receive antennas 300 and 304 are connected to low noise amplifiers 310 and 314, respectively. Correspondingly, re-broadcast antennas 302 and 306 are connected to power amplifiers 312 and 316, respectively. The signals from the low noise amplifiers 310 and 314 are captured by analog-to-digital converters (ADCs) 320 and 324, respectively. Signals generated by the system are shaped by pulse-shapers 322 and 326 before they are presented to power amplifiers 312 and 316 for rebroadcasting, respectively.

The pulse-shapers 322 and 326 are driven by a series of counters with latches 330–336. The counters/latches are in turn controlled by a decision logic block 340. The decision logic block 340 also controls a digital-to-analog converter (DAC) 342, which drives a voltage to frequency converter or amplitude to frequency converter AFC 344. The AFC 344 is electrically connected to a crystal 346 for precision clock timing. The clock signal is controlled with a phase-locked loop (PLL) 350.

The system of FIG. 4B operates in a manner similar to a bat echo-locating its prey; however in this case the distance/angle measurement is accomplished by establishing a communication link, not over a physical signal reflection. A passive signal detection system using reflections is subject to environmental signal absorption and only works in unobstructed environments.

For narrow time pulses, the signals arriving at the receiver will be composed of the original pulses (shortest path) plus pulses that have been delayed by reflections. These pulses are on the order of 1ns for 1 meter resolution. The system is set to provide sufficient time between the pulses that the re-broadcast pulses will not interfere with the received pulses, even taking into account multiple reflections and fading. The pseudo-code executed by the decision logic block 340 is as follows:

1. Pulse train emitted. The pulses are sent at a specific rate, say 100/microsecond. That means that a large number of pulses can be sent over a short time. The pulse sequence contains information about the system clock timing of the transmitter.
2. As the first pulse reaches the low noise amplifier (LNA) array, the pulse triggers a comparator which then triggers a memory cell.
3. Also triggered is an internal timing chain, starting a PLL running at 1 GHz off a crystal clock. The PLL timing will be adjusted by the incoming clock so reproduce the received signal.
4. The receiver will then start beaming back a sequence of pulses back to the original transmitter.
5. The transmitter will now receive the re-broadcast signal and note any time differences between the original sequence and the received sequence. The sequence will contain many known patterns to establish reference points regardless of the delay between the receiver and transmitter. The time difference can be used to compute the distance between the receiver and the transmitter based on the known speed of electromagnetic waves.

Other systems that could be employed are phase difference measurement or triangulation, using the reflected pulses as multiple virtual sources. These other location detection methods could be used in conjunction with time-of-arrival to improve the overall location accuracy and reliability.

Figure 5A:
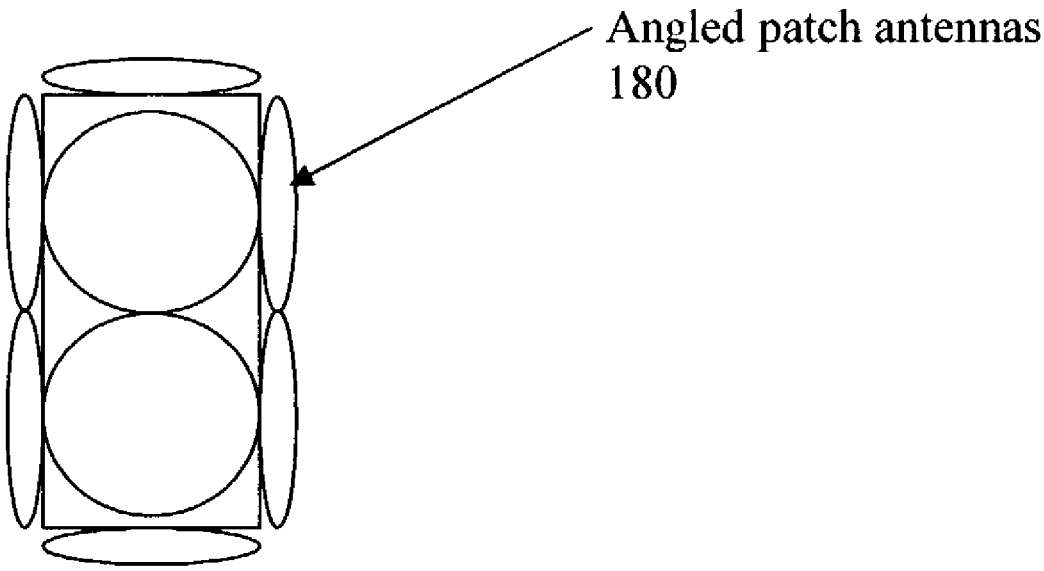
FIG. 5A shows an embodiment with a plurality of antennas for the device of FIG. 4A or 4B.

The wireless transceiver core 130 is connected to a plurality of angled patch antennas 180. One embodiment of the patch antenna 180 is shown in FIG. 5A. Each antenna 180 is positioned such that the arrival delay of different signals tells the receiver which signal comes from the transmitter, and what signal is scattered. In this embodiment, the antennas 180 are positioned such that relative reception angle can be determined from the received intensity versus time.

In one embodiment, the patch antennas 180 are positioned on a watch. Since a typical watch has a dimension of about 4 cm, a signal delay across it will be about 100 ps, which is several inverter delay times in a typical CMOS process. A timing circuit could thus be easily designed to calculate the arrival angle based on the time of arrival at a given antenna.

The distance measurement is accomplished by an active communication between the two units, as opposed to one unit 'looking' for the other unit. When one unit senses emissions from the other unit, it starts its own emissions which eventually are used to synchronize with the first unit.

Figure 5B:
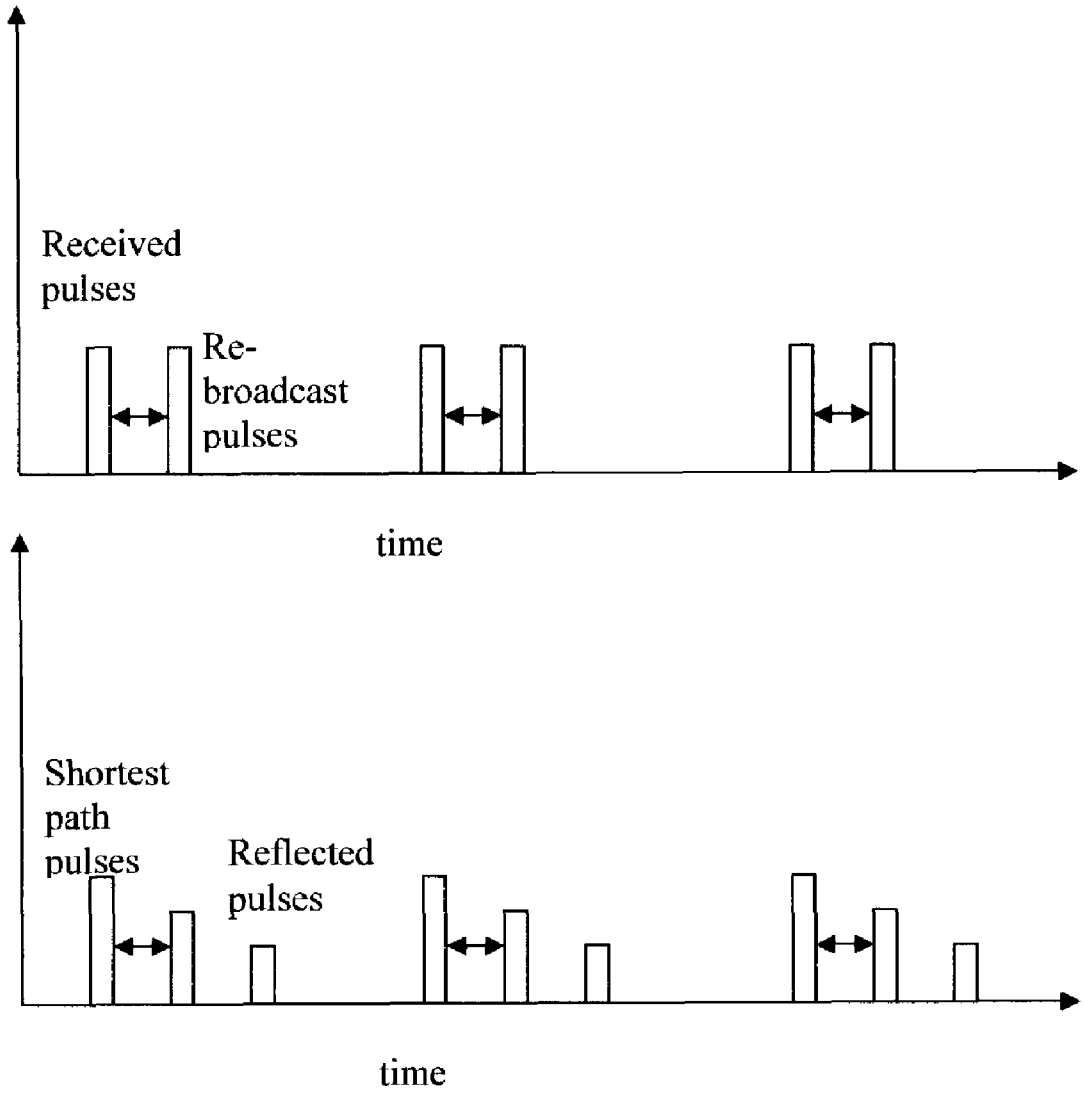
FIG. 5B illustrates an exemplary timing diagram for the antennas of FIG. 5A.

FIG. 5B shows an exemplary timing diagram for both time and angle information coming from the different antennas. In the top diagram, when the transmitter of the first unit sends a known, pre-arranged startup sequence of pulses, the receiver will be able to discern the pulses from echoes and reflections by keeping track of the known pulse timing. The receiver at the second unit will then send its own 're-broadcast' series of pulses which will be received at the transmitter of the first unit. The transmitter will then be able to correlate its own known pulse send time with the time of the 'rebroadcast' pulse receipt. This time will be equal to the round-trip distance between the transmitter and the receiver. The bottom diagram of FIG. 5B also shows additional echo pulses or signals. The additional echo pulses caused by secondary reflections can be used to increase the system accuracy by predicting the type of obstacle is being encountered and comparing the obstacle to a list of reflection signatures stored on the microprocessor memory. In the presence of noise and multiple reflections, several well known techniques from cellular telephony such as Reed-Solomon coding and Viterbi coding can be used to make the signal more robust.

Figure 6:
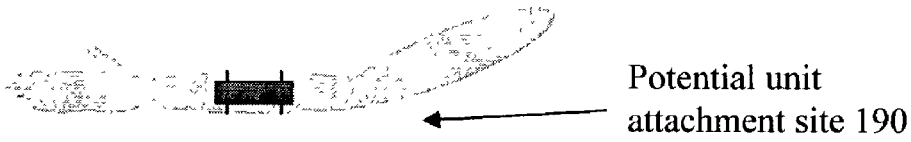
FIG. 6 shows an embodiment for mounting the antennas.

In a second embodiment, the patch antennas 180 are worn on a user's wrist. FIG. 6 illustrates a strap 190 that is secured on the user's wrist. The strap 190 is woven to make shielding difficult. In one embodiment, the antennas 180 on the transmitter unit is distributed on the entire body. The strap 190 is made from metal antenna fibers that are woven into clothing to prevent shielding. With an antenna this size an extremely low frequency (ELF) signal is generated, which is very difficult to completely shield.

GPS and cellular can be used as options. With these options, the parent can keep track of the child's whereabouts over much larger distances, though such systems are more prone to tampering.

One of the problems with any electromagnetic system is that it can be shielded with a simple metal shroud. GPS systems are particularly susceptible, since signal levels are so weak. Several techniques are used to prevent this from happening. If the signal strength suddenly drops, the transceiver unit will initiate an alarm. At the same time, the transmitter will emit an audible alarm.

One significant problem is the assailant grabbing the child and abducting the child into a car, which would immediately shield the signal, especially GPS signals. In this case, the transmitter would attempt to communicate with the transceiver unit with a power surge emission. Such emissions would be difficult to shield completely. The transmission could be fairly brief and so would not significantly interfere with existing wireless equipment. Such systems only give information about the child's whereabouts, but in the first few minutes of an abduction, this is very important. The signal's Doppler shift could be used to determine the relative signal velocity. Thus, every time there is a rapid shift in the child's position, the alarm would immediately sound at an increasing level. A child is unlikely to move at more than one meter per second, and if a higher speed is detected, then the child is probably being abducted.

The child's alarm would not activate until the unit was out of range of the base unit or the lock mechanism was being tampered with. One important criterion is to reduce the number of false alarms, which would de-sensitize the users to the unit's alarm systems. Therefore, both units will have programmable microprocessors which can be set to a certain distance. For example, a mall may require a smaller distance than a park, and the environment may be preset to specific conditions.

The transmitter on the base unit can become useless if it not attached to the child. Therefore the transmitter is made difficult to remove. The mechanical locks cannot be opened with a key, but with a code generated by the transceiver on the master unit. The parent keys in a sequence on the master unit to disarm the base unit. The alarm sounds every time the unit is tampered with, and the locks and straps are made from lightweight but strong magnesium steel alloy. Additionally, the battery is a rechargeable unit that cannot be easily removed from the main device. To avoid having the battery run out of charge during operation, an alarm will sound when the battery level is low.

Figure 7:
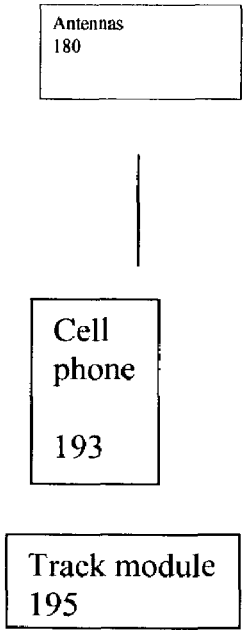
FIG. 7 shows a second embodiment of a system to track an object such as a person.

FIG. 7 shows a second embodiment where a tracking module 195 or search unit can communicate with or can be embedded in a cellular phone 193. Most cell phones now have a computer interface and their internal functions can be accessed externally. More detailed location capability is achieved by allowing the transmitter to listen in to cellular transmissions. This would enable the unit to pinpoint its position down to a mobile cell (about 1 square mile), and the directional capabilities would give an even more precise position and relation to the cellular emission antenna. This embodiment minimizes the number of devices that the user needs to carry to avoid requiring the user to carry yet another device. This embodiment is also small and not visible.

Yet other embodiments provide a digital camera which transmits images of the surroundings to the base unit. Other optional, advanced features include video games to entertain the child, an MP3 player and an FM radio.

Figure 8:
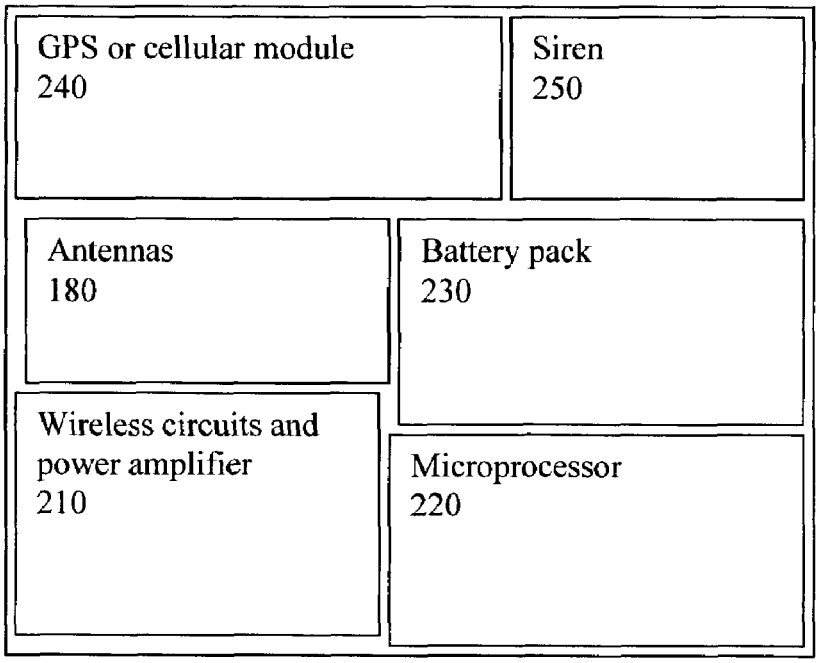
FIG. 8 shows a third embodiment of a system to track an object such as a person.

FIG. 8 shows an embodiment of a master unit. The master unit includes a microprocessor 220. The processor 220 communicates with optional GPS or cellular modules 240. The processor 220 can also drive a siren 250. The processor 220 receives energy from a battery pack 230, and communicates wirelessly with the base unit using a wireless circuit and power amplifier 210.

In one embodiment, the processor can be a reduced instruction set computer (RISC) processor or a complex instruction set computer (CISC) processor. In one embodiment, the processor 220 is a low power CPU such as the MC68328V DragonBall device available from Motorola Inc. The processor 220 is connected to a read-only-memory (ROM) for receiving executable instructions as well as certain predefined data and variables. The processor 220 is also connected to a random access memory (RAM) for storing various run-time variables and data arrays, among others. The RAM size is sufficient to store user application programs and data. In this instance, the RAM can be provided with a back-up battery to prevent the loss of data even when the computer system is turned off. However, it is generally desirable to have some type of long term storage such as a commercially available miniature hard disk drive, or non-volatile memory such as a programmable ROM such as an electrically erasable programmable ROM, a flash ROM memory in addition to the ROM for data back-up purposes.

The computer system receives instructions from the user via one or more switches such as push-button switches in a keypad. The processor 220 is also connected to a real-time clock/timer that tracks time. The clock/timer can be a dedicated integrated circuit for tracking the real-time clock data, or alternatively, the clock/timer can be a software clock where time is tracked based on the clock signal clocking the processor 220. In the event that the clock/timer is software-based, it is preferred that the software clock/timer be interrupt driven to minimize the CPU loading. However, even an interrupt-driven software clock/timer requires certain CPU overhead in tracking time. Thus, the real-time clock/timer integrated circuit is preferable where high processing performance is needed.

The processor 220 drives an internal bus. Through the bus, the computer system can access data from the ROM or RAM, or can acquire I/O information such as visual information via a charged coupled device (CCD) camera. The CCD unit is further connected to a lens assembly (not shown) for receiving and focusing light beams to the CCD for digitization. Images scanned via the CCD unit can be compressed and transmitted via a suitable network such as the Internet, through Bluetooth channel, cellular telephone channels or via facsimile to a remote site.

Additionally, the processor 220 is connected to the wireless tracking device of FIG. 4, which is connected to an antenna 180. The processor 220 can accept handwritings as an input medium from the user. A digitizer, a pen, and a display LCD panel are provided to capture the handwriting. The assembly combination of the digitizer, the pen and the LCD panel serves as an input/output device. When operating as an output device, the screen displays computer-generated images developed by the CPU 220. The LCD panel also provides visual feedback to the user when one or more application software execute. When operating as an input device, the digitizer senses the position of the tip of the stylus or pen on the viewing screen and provides this information to the computer's processor 220. In addition to the vector information, the display assembly is capable of sensing the pressure of the stylus on the screen can be used to provide further information to the CPU 220.

The computer system is also connected to one or more input/output (I/O) ports which allow the CPU 220 to communicate with other computers. Each of the I/O ports may be a parallel port, a serial port, a universal serial bus (USB) port, a Firewire port, or alternatively a proprietary port to enable the computer system to dock with the host computer. In the event that the I/O port is housed in a docking port, after docking, the I/O ports and software located on a host computer (not shown) support an automatic synchronization of data between the computer system and the host computer. During operation, the synchronization software runs in the background mode on the host computer and listens for a synchronization request or command from the computer system. Changes made on the computer system and the host computer will be reflected on both systems after synchronization. Preferably, the synchronization software only synchronizes the portions of the files that have been modified to reduce the updating times.

Although specific embodiments of the present invention have been illustrated in the accompanying drawings and described in the foregoing detailed description, it will be understood that the invention is not limited to the particular embodiments described herein, but is capable of numerous rearrangements, modifications, and substitutions without departing from the scope of the invention. The following claims are intended to encompass all such modifications.

What is claimed is:

1. A portable apparatus to track an object, comprising:

a transmitter adapted to sending pulses of known duration, intensity and angle of arrival;

a single-substrate CMOS receiver having one or more antennas to receive the pulses of known duration, intensity and angle of arrival from the transmitter along with reflected pulse echoes, the receiver and the transmitter having synchronized clocks to resolve distance to the transmitter by comparing signal arrival time differences in clock cycles from reflected echoes captured by the one or more and wherein the angle to transmitter is simultaneously calculated by comparing the signal strength and arrival time from the one or more antennas and wherein an alarm is generated if the determined distance exceeds a preset value.

2. The apparatus of claim 1, wherein the antenna is positioned on a wearable object.

3. The apparatus of claim 1, wherein the antenna is positioned on a watch.

4. The apparatus of claim 1, wherein the antenna is positioned on a body strap.

5. The apparatus of claim 4, wherein the strap further comprises metal antenna fibers woven into clothing to prevent shielding.

6. The apparatus of claim 4, wherein the antenna transceives extremely low frequency signals.

7. The apparatus of claim 1, wherein the antenna is a patch antenna.

8. The apparatus of claim 1, wherein the antenna is an angled patch antenna.

9. The apparatus of claim 1, wherein the antenna is an angled patch antenna with one or more rake fingers.

10. The apparatus of claim 9, wherein the receiver captures angle of arrival information using multiple patch antennas with a plurality of rake fingers.

11. The apparatus of claim 10, wherein the receiver integrates signals from different antennas using a modified CDMA detection process.

12. The apparatus of claim 10, wherein prompt, late, early entries received by the rake fingers are correlated to determine arrival angles.

13. The apparatus of claim 1, wherein the transmitter and receiver are selected from either 802.11 transmitter and receiver or Bluetooth transmitter and receiver.

14. The apparatus of claim 1, wherein the antenna is positioned on a secured body strap that can only be opened remotely.

15. The apparatus of claim 1, wherein the object is a biological object.

16. A portable apparatus to track an object, comprising:

a transmitter adapted to sending pulses of known duration and intensity;

a receiver to receive the pulses of known duration and intensity from the transmitter, wherein the receiver and the transmitter operate with synchronized clocks to determine signal propagation time and distance and wherein the receiver captures angle of arrival information using one or more patch antennas with a plurality of rake fingers and signals from different antennas are processed using a modified CDMA detection process; and the one or more patch antennas coupled to the receiver, the antennas having metal antenna fibers woven into clothing to prevent shielding, wherein an alarm is generated if the determined distance exceeds a preset value.

17. The apparatus of claim 16, wherein the transmitter and receiver comprises either 802.11 transmitter and receiver or Bluetooth transmitter and receiver.

18. The apparatus of claim 16, wherein the antenna transceives extremely low frequency signals.

19. The apparatus of claim 18, wherein the location signals comprises ultrasound signals.

20. The apparatus of claim 16, wherein the transmitter communicates with a remote network to transmit a user code and an approximate location as determined by the network.

21. The apparatus of claim 20, wherein the network comprises one of a local area network (LAN) and a wide area network (WAN).

22. The apparatus of claim 20, wherein the network comprises one of a 802.11 network, a Bluetooth network, and a cellular network.

23. The apparatus of claim 20, wherein the user code and approximate location tunnel through the network to a police computer or a national database.

24. The apparatus of claim 16, wherein the distance measurement is accomplished by an active communication between the two units.

25. The apparatus of claim 24, further comprising a remote second unit with a second transmitter and a second receiver, wherein when the remote second unit senses emissions from the transmitter and receiver and emits signals to synchronize with the transmitter and receiver.

* * * * *